US007232479B2

(12) United States Patent
Poulet et al.

(10) Patent No.: US 7,232,479 B2
(45) Date of Patent: Jun. 19, 2007

(54) COATING COMPOSITION FOR A METAL SUBSTRATE

(75) Inventors: Jean-Marie Poulet, Senlis (FR); Alain Chesneau, Creil (FR); Georges Leger, Liancourt (FR); Denis Begue, Bresles (FR)

(73) Assignee: Dacral, Creil (FR)

( * ) Notice: Subject to any disclaimer, the term of this patent is extended or adjusted under 35 U.S.C. 154(b) by 0 days.

(21) Appl. No.: 10/508,347

(22) PCT Filed: Mar. 18, 2003

(86) PCT No.: PCT/FR03/00863

§ 371 (c)(1),
(2), (4) Date: Sep. 21, 2005

(87) PCT Pub. No.: WO03/078683

PCT Pub. Date: Sep. 25, 2003

(65) Prior Publication Data

US 2006/0086281 A1 Apr. 27, 2006

(30) Foreign Application Priority Data

Mar. 18, 2002 (FR) ..... 02 03353

(51) Int. Cl.

| | |
|---|---|
| ***C23F 11/00*** | (2006.01) |
| ***C09K 3/00*** | (2006.01) |
| ***C23C 22/60*** | (2006.01) |
| ***C23C 22/48*** | (2006.01) |
| ***C23C 22/53*** | (2006.01) |
| ***B05D 1/02*** | (2006.01) |
| ***B05D 7/14*** | (2006.01) |

(52) U.S. Cl. ..... 106/14.44; 106/14.05; 106/14.21; 427/385.5; 427/386; 427/387; 427/388.4; 427/397.8; 428/457

(58) Field of Classification Search ..... 106/14.05, 106/14.21, 14.41, 14.44; 427/385.5, 386, 427/387, 388.4, 397.8; 428/457
See application file for complete search history.

(56) References Cited

U.S. PATENT DOCUMENTS

| | | | | |
|---|---|---|---|---|
| 3,565,675 | A | 2/1971 | Sams | |
| 3,884,863 | A | 5/1975 | Beers et al. | |
| 4,169,916 | A | 10/1979 | Tsutsui et al. | |
| 4,677,160 | A * | 6/1987 | Kondo et al. | 524/860 |
| 5,854,190 | A * | 12/1998 | Knipe et al. | 510/241 |
| 5,859,124 | A * | 1/1999 | Yorifuji et al. | 524/837 |
| 5,908,501 | A * | 6/1999 | Pucillo | 106/634 |
| 6,478,886 | B1 * | 11/2002 | Kunz et al. | 148/268 |
| 6,638,628 | B2 * | 10/2003 | Savin | 428/446 |

FOREIGN PATENT DOCUMENTS

| | | |
|---|---|---|
| CS | 231073 | 9/1984 |
| DE | 2636132 | 6/1977 |
| DE | 19814605 | 10/1999 |
| EP | 0016298 | 9/1983 |
| EP | 0240940 | 10/1994 |
| EP | 0648823 | 5/1995 |
| FR | 2837218 A1 * | 9/2003 |
| JP | 62127366 | 11/1987 |
| JP | 63072887 | 12/1995 |
| WO | WO 9401593 | 9/1994 |

OTHER PUBLICATIONS

Derwent Patent Abstract No. 1985-263987 (abstract of German Patent Specification No. DD 224337A (Jul. 1985).*
Barton, "Primer for zinc, aluminum and their alloys before organic coating," Chemical Abstracts, vol. 105, No. 14, Abstract # 105:11960U (Mar. 1986).

* cited by examiner

*Primary Examiner*—Anthony J. Green
(74) *Attorney, Agent, or Firm*—Fay Sharpe LLP

(57) ABSTRACT

The invention relates to a coating composition for a metal substrate exhibiting a free outer surface consisting of a metal coating based on zinc or a zinc-based alloy, characterized in that it comprises: silicate(s) of sodium and/or potassium and/or lithium (3-35 wt. %), a tensioning agent (à.01-1 wt. %), the remainder being water in a quantity sufficient to arrive at 100 %.

42 Claims, 1 Drawing Sheet

COATING COMPOSITION FOR A METAL SUBSTRATE

BACKGROUND

The subject of the present invention is a coating composition for a metal substrate, based on an aqueous sodium and/or potassium and/or lithium silicate solution.

The present invention also relates to the methods of applying this composition to the said metal substrate and to the various uses of this coating composition.

According to the present invention, the coating composition is intended to be applied to a steel substrate having a free outer surface formed by a zinc or zinc-based alloy metal layer.

In one advantageous embodiment, the said metal layer may have been deposited on the said steel substrate electrolytically or by hot dipping.

As an example of metal substrates, mention may be made of:

- electrogalvanized sheets: steel substrate coated with a zinc layer applied electrolytically;
- hot-dipped galvanized sheets: steel substrate coated with a zinc layer applied by dipping the said sheet into a bath of molten zinc;
- GALFAN: steel substrate coated with a layer of a zinc (95 wt %)/aluminium (5 wt %) alloy applied by dipping in a bath of molten zinc/aluminium alloy having the same proportions; and
- GALVALUME®: steel substrate coated with a layer of an aluminium (55 wt %)/zinc (45 wt %) alloy applied by dipping in a bath of molten aluminium/zinc alloy having the same proportions.

The treatment of a metal surface is subject to many simultaneous constraints of a technical, economic and environmental type.

Coils of sheet are produced in steel plants by very rapid processes, the line speed of which may range from a few m/min up to 250 m/min. When it is desired to couple the production process to a surface treatment step, the surface treatment technologies must comply with these line speed constraints. Technical difficulties may therefore arise if it is desired to maintain good chemical reactivity between the substrate and the treatment products, but also as regards film formation if it is desired to obtain good flow and good homogeneity of the film coatings.

Anticorrosion treatment technologies usually make use of chromium-based products (the chromium being hexavalent or trivalent) that are applied as one or more layers. However, these products are environmentally harmful and have to be replaced with treatment products having no impact on the environment.

In addition, manufacturers at the present time are seeking to employ a technology that meets a minimum specification and is capable of being functionalized so as to meet stricter requirement levels and to increase the added value of the surface treatment.

As a complement to corrosion resistance, the functionalization of the treatments relates in particular to the following fields:

- the surface properties such as the hydrophobicity or hydrophilicity of the surface, the anti-fingerprint character of the surface or else the modification of the free alkalinity of the surface;
- the application properties, such as the flexibility and the lubrication of the coating for bending or drawing operations, but also the electrical conductivity in the case of joining by welding.

Manufacturers are also subject to economic constraints and thus seek compact treatments using formulations that are, on the one hand, prepared in aqueous medium (and that therefore do not require additional investment for the reprocessing of possible organic solvents) and that, on the other hand, allow application of a single layer with a single drying operation.

Finally, the on-line operating constraints also require products that are, on the one hand, one-component products (i.e. products that do not require the preparation of a mixture of several products prior to industrial application) and are, on the other hand, stable over time (i.e. have a lifetime of more than three weeks in order to accommodate campaign production runs).

SUMMARY

The subject of the present invention is a composition that satisfies the abovementioned requirements and constraints.

The coating composition according to the invention is characterized in that it comprises (in % by weight):

- sodium and/or potassium and/or lithium silicate(s): 3%-35%
- surfactant: 0.01%-1%
- water: qsp 100%.

The said sodium and/or potassium and/or lithium silicate and the said surfactant will be explained later in the present description.

As indicated above, the coating composition is intended to be applied to a metal substrate. The wet film thus obtained is then dried and giving rise to a dry coating film.

DETAILED DESCRIPTION

Figure 1:
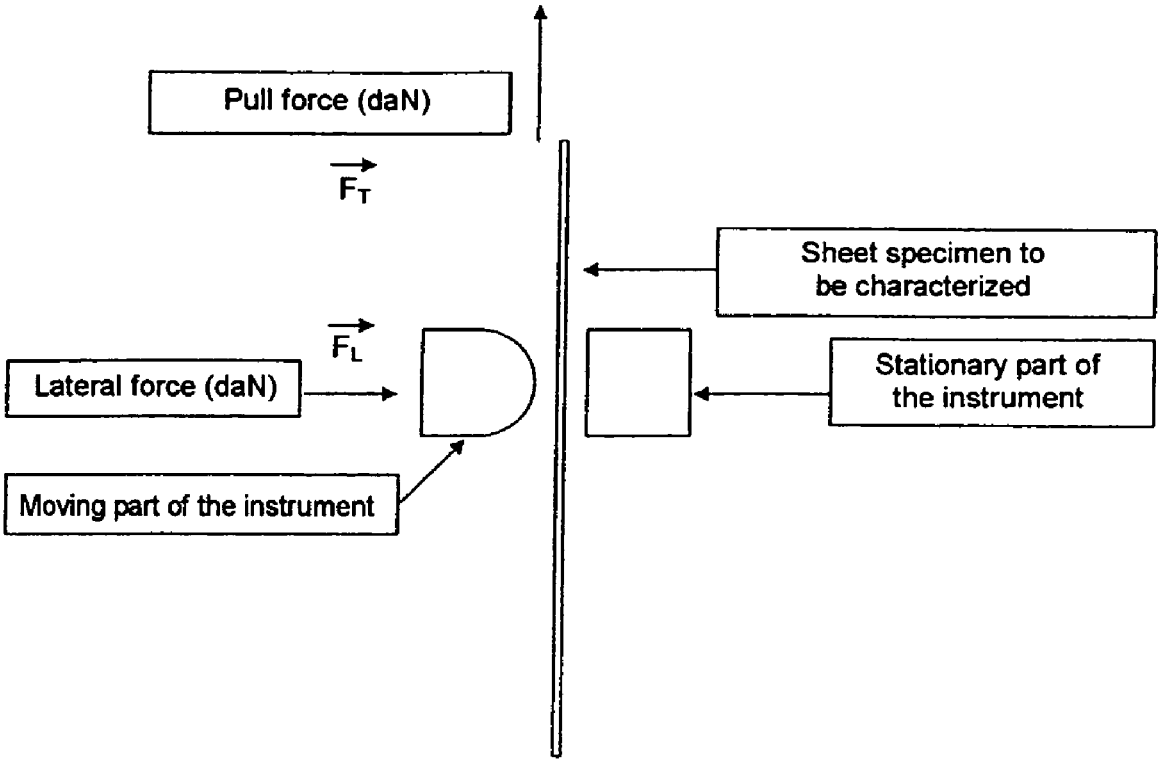
FIG. 1 is a schematic illustration of an apparatus used in testing the friction characteristics of a specimen.

Unless otherwise indicated, all the percentages given in the context of the present description are percentages expressed by weight relative to the total weight of the said coating composition in liquid form. Otherwise, the proportions of the constituents are expressed relative to the dry coating film, that is to say in solids by weight relative to the total weight of the dry coating film obtained.

The coating composition preferably contains 5 to 30 wt % sodium and/or potassium and/or lithium silicate(s), more preferably 5 to 20 wt % sodium and/or potassium and/or lithium silicate(s) and even more preferably 8 to 15 wt % sodium and/or potassium and/or lithium silicate(s).

Advantageously, this coating composition maybe prepared in the form of a concentrate in which the percentage of sodium and/or potassium and/or lithium silicate(s) may be up to about 40% by weight, or else in the form of a powder in which the percentage of sodium and/or potassium and/or lithium silicate(s) may be up to about 80% by weight.

Within the context of the present invention, sodium silicate may be used in the said composition in the form of an aqueous sodium silicate solution of the following composition by weight:

$SiO_2$: 20%-40%

$Na_2O$: 5%-20%

Water: qsp 100%.

This sodium silicate solution may also contain a small proportion of $Na_2CO_3$ of around 0.1% by weight relative to the weight of the silicate solution.

Potassium silicate may be used in the said composition in the form of an aqueous potassium silicate solution of the following composition by weight:

$SiO_2$: 15%-35%

$K_2O$: 5%-35%

Water: qsp 100%.

Lithium silicate may be used in the said composition in the form of an aqueous lithium silicate solution of the following composition by weight:

$SiO_2$: 15%-40%

$Li_2O$: 1%-10%

Water: qsp 100%.

The subject of the present invention is also the dry coating film that can be obtained within the method (described below) for applying the coating composition to a metal substrate. This dry coating film is characterized in that it comprises at least 40% solids by weight of sodium and/or potassium and/or lithium silicate(s), preferably between 60% and 99.9% by weight relative to the total weight of the dry coating film.

Within the meaning of the present invention, the term "surfactant" is understood to mean an additive whose function is to lower and control the liquid surface energy of the composition (or surface tension). The surface energy is the energy needed to bring the molecules from the interior of the liquid of the composition to its surface. The lower the surface energy of the composition, the greater the wettability of the surface of the metal substrate. Wettability is the ability of the said substrate to receive a liquid by allowing it to spread out over the largest possible area.

The surface energy of the composition is preferably adjusted so as to obtain good wettability of the surface to be coated under high line speed conditions before the product solidifies on entering the drying zone.

The coating composition contains between 0.01 to 1% by weight of a surfactant, preferably about 0.1% by weight of a surfactant.

Advantageously, a coating composition is thus obtained that has a surface tension value of between 20 and 50 dynes/cm (20 mN/m and 50 mN/m), preferably between 22 and 45 dynes/cm (22 mN/m and 45 mN/m) and more preferably between 22 and 40 dynes/cm (22 mN/m and 40 mN/m).

The surfactant may be added separately or at the same time as incorporating another constituent containing such a surfactant, for example a dispersion or emulsion of a polymer.

As examples of surfactants, mention may be made of polypropylene glycol/polyethylene glycol copolymers, (such as PLURONIC PE 3100® manufactured by BASF), silicone-based resins (such as BYK348® manufactured by BYK), acetylene glycols (such as DYNOL604® manufactured by Air Products), anionic and nonionic mixtures (such as DAPRO W95 HS® sold by Elementis), quaternary ammoniums (such as CYCLOQUART® manufactured by Clariant), modified polyethoxylated alcohols (such as TRITON DF16® manufactured by Union Carbide) as well as compatible mixtures thereof.

The surfactant may be added to the composition according to the present invention in the form of an aqueous solution, a dispersion or an emulsion in water, with or without a cosolvent.

Advantageously, the water used in the coating composition according to the present invention is subjected beforehand to a deionization process so that the conductivity of this water is less than about 20 μS/cm.

Under these operating conditions, the pH of the coating composition may be an alkaline pH, preferably between 11 and 13 and more preferably between 11 and 12.

According to one feature of the invention, the coating composition may furthermore contain a polymer whose function is to lower the glass transition temperature of the dry coating film.

When the said composition is applied to a substrate and has then been subjected to a drying operation, the presence of the said polymer gives the dry coating film thus obtained elasticity and flexibility properties. The said polymer therefore makes it possible to minimize or eliminate the appearance of cracks within the dry coating film when the metal substrate undergoes subsequent mechanical deformation.

As examples of the said polymer, mention may be made in particular of acrylic polymers or copolymers such as POLYSOL M-19® (manufactured by Showa Highpolymer Co. Ltd.) or RHODOPAS D-20 40® (manufactured by Rhodia), polyurethanes, alkyds, epoxy esters as well as compatible mixtures thereof.

Advantageously, the said polymer may be added to the composition according to the present invention in the form of a dispersion or of an emulsion in water or of an aqueous solution, in a proportion that advantageously makes it possible to obtain up to 60% by weight of the dry coating film.

In this form, the said polymer may at the same time deliver the abovementioned surfactant to the composition.

According to another feature of the invention, the coating composition may furthermore contain an additive for increasing the hydrophobicity of the dry coating film, in a proportion that advantageously makes it possible to obtain up to 50% by weight of the dry coating film, preferably up to 25% by weight of the dry coating film.

This additive is advantageously a silane, preferably chosen from functionalized dimethoxysilanes or trimethoxysilanes or diethoxysilanes or triethoxysilanes, as well as mixtures thereof. The organic functionality may be of the vinyl, amine or oxirane (epoxy) type. Preferably, the silane is chosen from epoxy-functionalized silanes such as β-(3,4-epoxy-cyclohexyl)ethyltrimethoxysilane, 4-(trimethoxysilyl)-1,2-butane epoxide or γ-glycidoxypropyltrimethoxysilane.

The silane may also act as a binding agent and as a stabilizer for the coating composition and may allow the corrosion resistance of the dry coating film to be increased.

These silanes may be used independently or in combination in prehydrolyzed or non-prehydrolyzed form.

Introduction of the silane may also be accompanied by the addition of a titanate or a zirconate in order to strengthen the crosslinking of the binder system depending on the properties required of the coating.

The increase in hydrophobicity of the dry coating film may be observed visually, especially in cyclic corrosion tests (according to DIN 50017 KTW), by the formation of droplets of condensed water vapour (coming from the electrolyte) that are less spread than in the case of a coating whose binder is composed only of a silicate.

It is assumed that introducing the silane into the coating composition decreases the porosity of the dry coating film and/or reduces the permeability to the electrolyte of the said film, thus giving the latter its hydrophobicity.

The hydrophobicity of the dry coating film by introducing the silane into the coating composition makes it possible to apply a dry film of smaller thickness for the same corrosion resistance results.

According to another feature of the invention, the coating composition may furthermore contain an additive for reducing the free surface alkalinity of the dry coating film, in a proportion that makes it possible advantageously to obtain up to 25% by weight of the drying coating film.

This additive is preferably a (Ce) cerium salt, a lanthanum (La) salt, a molybdenum (Mo) salt, molybdic acid, paratoluenesulphonic acid, as well as salts thereof, or else a polyol such as glycerol, and mixtures thereof.

According to another feature of the invention, the coating composition may furthermore contain an additive for increasing the anticorrosion properties of the dry coating film, in a proportion that makes it possible advantageously to obtain up to 25% by weight of the dry coating film.

This additive is preferably a mineral binder, such as a titanate or a zirconate, as well as mixtures thereof.

According to another feature of the invention, the coating composition may furthermore contain a lubricant. As examples of lubricants, mention may be made in particular of synthetic organic polymers, such as polytetrafluoroethylene, polyethylene and polyethylene glycol, or natural organic polymers, such as carnauba wax or paraffin waxes, as well as mixtures thereof. The lubricant is added to the coating composition in a proportion that makes it possible to obtain up to 15% by weight of the dry coating film, preferably between 1.5 and 15% by weight of the dry coating film, more preferably between 3 and 15% by weight of the dry coating film and even more preferably between 5 and 15% by weight of the dry coating film.

In practice, it turns out that the lubricant may require a stabilizer so as to prevent phase separation in the coating composition.

As examples of stabilizers, mention may be made in particular of organophilic clays (both natural or synthetic clays), silica derivatives, cellulose derivatives, xanthan gum or associative thickeners of the polyurethane or acrylic type, as well as mixtures thereof.

Advantageously, the stabilizer is added to the coating composition according to the present invention in a proportion that makes it possible to obtain between about 0.1 and 5% by weight of the dry coating composition.

According to another feature of the invention, an antifoam agent may also be added to the coating composition, the said antifoam agent being chosen so as to be compatible with the other constituents of the coating composition and the optimum quantity of which is determined using conventional routine experiments known to those skilled in the art.

Under the conditions for obtaining the composition according to the present invention, the said composition may be essentially devoid of any organic solvent. This is because organic solvents have proved in practice to be not very compatible with sodium and/or potassium and/or lithium silicates, these being the main constituents of the coating composition.

The present invention also relates to a method of coating a metal substrate, which comprises the application of the coating composition described above to the surface of the said substrate.

Within the framework of the present invention, the coating composition described above is applied during an operation that consists in depositing a wet film of the said composition, with an appropriate small thickness, followed by an operation of drying the said metal substrate thus coated, giving rise to a dry coating film on the said substrate.

Advantageously, the thickness of the wet film of the coating composition deposited on the metal substrate is between 0.3 and 39 μm, preferably between 0.3 and 30 μm, and the wet film is applied in an amount of 0.6 to 40 g/m$^2$, preferably 0.6 to 24 g/m$^2$.

The method according to the present invention may be carried out in line, after the step of zinc or zinc-based alloy metal coating the steel substrate, or on a rework line, such as on a coil-coating line.

According to the method forming the subject of the present invention, the operation of depositing the wet film of the coating composition on the metal substrate may be advantageously carried out by spraying, by spraying followed by an operation to drain off excess liquid, by dipping followed by an operation to drain off excess liquid, or by means of a coating system composed of at least one roll.

In the case of spraying or dipping, the operation to drain off excess liquid allows the thickness of the wet film deposited on the metal substrate to be controlled. This operation to drain off excess liquid may be advantageously carried out using a set of drain-off rolls.

In an advantageous method of implementing the present invention, the operation of drying the metal substrate coated with the wet film is carried out by heating the metal substrate or the wet thread so as to heat the said metal substrate and the said wet film to a temperature between room temperature and 240° C. The heating operation may be carried out directly by induction, or indirectly by convection or by infrared. Convection heating generally requires a longer drying time than induction or infrared heating. This drying operation is advantageously carried out by heating the metal substrate or the wet film so as to heat the said metal substrate and the said wet film preferably to a temperature of at least about 35° C. for a time of at least 2 seconds if convection heating is used and for a maximum time of 10 seconds, preferably 5 seconds, more preferably from 1 to 2 seconds, if induction or infrared heating is used.

Advantageously, the drying operation is carried out so as to obtain a dry coating film thickness of between 0.05 and 0.80 μm, preferably between 0.05 and 0.60 μm, and so as to obtain a dry coating film layer weight of between 0.1 g/m$^2$ and 1.3 g m$^2$, preferably between 0.2 g/m$^2$ and 1.2 g/m$^2$, more preferably between 0.2 to 0.5 g/m$^2$.

According to one particular example of the method forming the subject matter of the present invention, the wet film deposition and drying operations are carried out between the operation of depositing the zinc or the zinc-based-alloy metal coating on the said steel substrate and the final coiling operation.

The present invention also relates to the various uses of the coating composition according to the present invention.

According to one feature of the present invention, the coating composition may be used as an anti-corrosion protection layer for metal sheets when it is applied to the said sheets. Advantageously, the said composition may be used as an anti-corrosion protection layer for metal sheets intended to be temporarily stored.

When the said coating composition is applied to a metal substrate that is passed through cleaning baths, such as for example during a motor-vehicle painting sequence, the chemical resistance of the coating layer obtained depends on many parameters, including in particular:

- the conditions for drying the said substrate coated with the wet film during the process of applying the coating composition;
- the temperature and the alkalinity of the cleaning baths; and
- the immersion time of the substrate in the cleaning baths.

For example, during the cleaning baths of a motor-vehicle painting sequence, a layer of the dry coating film according to the present invention, when it has been applied to a metal substrate and then dried at 240° C., is completely resistant to the said cleaning baths. However, when it has been dried at 145° C., the said layer of dry coating film is partly dissolved by the cleaning baths and when it has been dried at 50° C., it is completely dissolved by the cleaning baths.

Advantageously, the coating composition may be used as a lubrication layer when it also contains a lubricant and when it is applied to metal sheets for the purpose of forming them, in particular with a view to folding, bending and drawing the said metal sheets.

According to another feature of the present invention, the coating composition may be used as an anti-fingerprint agent. In practice, it has been observed that metal sheets covered with the coating composition forming the subject matter of the present invention may be handled as such without any traces of fingers remaining printed on the said metal sheets.

According to another feature of the present invention, the coating composition may be applied to metal substrate workpieces intended to be welded.

In the case in which thin coating films are applied, the said substrates thus coated retain their weldability property and the welding operations may be carried out directly.

In the case in which the coating film has a greater thickness, the coating composition may require the addition of conducting pigments, such as iron phosphite, ammonium silicate, nickel, tungsten, zinc (either pure or alloyed) and carbon, as well as mixtures thereof.

Other features and advantages of the present invention will become apparent in the light of the examples below. These examples are given by way of indication but imply no limitation.

EXAMPLE 1

Sodium Silicate-Based Coating Composition (A)

In the coating composition (A) formulated below, the following are used:

- sodium silicate solution (20N32® manufactured by Rhodia) meeting the following composition by weight:
  - $SiO_2$: 28.6% by weight
  - $Na_2O$: 8.9% by weight
  - $Na_2CO_3$: 0.1% by weight
  - Water: qsp 100% by weight
- surfactant: polypropylene glycol/polyethylene glycol copolymer with 10% polyethylene glycol in the molecule (PLURONIC PE 3100® manufactured by BASF).

1463.6 g of deionized water were introduced into a 5 liter beaker fitted with a Rayneri® disperser of the 33/300 type and with an 85 mm diameter deflocculating turbine, 4 g of PLURONIC PE 3100® were added with stirring (speed: 250 rpm), mixing was continued for 10 minutes at 350 rpm, 2532.4 g of sodium silicate solution (20N32®) were added with stirring (speed: 250 rpm) and mixing was continued for 30 minutes at 350 rpm.

| Coating composition (A) | % by weight |
|---|---|
| Sodium silicate | 23.7 |
| Surfactant | 0.1 |
| Water | 76.2 |

EXAMPLE 2

Sodium Silicate-Based Lubricated Coating Composition (B)

In the coating composition (B) formulated below, the following were used:

- the sodium silicate solution 20N329 used in Example 1 in composition (A);
- an aqueous emulsion containing 45% solids by weight of acrylic polymer POLYSOL M-19® manufactured by Showa Highpolymer Co. Ltd.;
- an aqueous emulsion containing 45% solids by weight of MICHEM® Emulsion 45745 polyethylene manufactured by Michelman; and
- an aqueous dispersion containing 41% solids by weight of MICHEM® Glide 5 polytetrafluoro-ethylene manufactured by Michelman.

385.3 g of deionized water were introduced into a 0.8 liter plastic pot fitted with a Reyneri® disperser of the 33/300 type and with a 55 mm diameter deflocculating turbine, 14.9 g of POLYSOL M-19® were added with gentle stirring (speed: 250 rpm), mixing was continued for 5 minutes, 17.2 g of MICHEM® Emulsion 45745 were added with gentle stirring (speed: 250 rpm), mixing was continued for 5 minutes, 9.7 g of MICHEM® Glide 5 were added with gentle stirring (speed: 250 rpm), mixing was continued for 5 minutes, 172.9 g of sodium silicate solution (20N32®) were added with gentle stirring (speed: 250 rpm) and then mixing was continued for 30 minutes with gentle stirring (speed: 250 rpm).

| Lubricated coating composition (B) | % by weight |
|---|---|
| Sodium silicate | 10.8 |
| Polytetrafluoroethylene (PTFE) | 0.7 |
| Polyethylene (PE) | 1.3 |
| Acrylic polymer | 1.1 |
| Water | 86.1 |

| Composition of the lubricated coating film (B) | % solids by weight |
|---|---|
| Sodium silicate | 78 |
| Acrylic polymer | 8 |
| PTFE and PE | 14 |

EXAMPLE 3

Potassium Silicate-Based Coating Composition (C)

In the coating composition (C) formulated below, the following were used:

- potassium silicate solution (K4/2® manufactured by Clariant) meeting the following composition by weight:
  - $SiO_2$: 26.5% by weight
  - $K_2O$: 12.9% by weight
  - Water: qsp 100% by weight
- the PLURONIC PE 3100® surfactant used in Example 1 in composition (A).

1535.2 g of deionized water were introduced into a 5 liter beaker fitted with a Rayneri® disperser of the 33/300 type and with an 85 mm diameter deflocculating turbine, 4 g of PLURONIC PE 3100® were added with stirring (speed: 250 rpm), mixing was continued for 10 minutes at 350 rpm, 2460.8 g of potassium silicate solution (K4/2®) were added with stirring (speed: 250 rpm) and mixing was continued for 30 minutes at 350 rpm.

| Coating composition (C) | % by weight |
|---|---|
| Potassium silicate | 24.2 |
| Surfactant | 0.1 |
| Water | 75.7 |

EXAMPLE 4

Lithium Silicate-Based Coating Composition (D

In the coating composition (D), formulated below, the following were used:

lithium silicate solution (KLEBOFON 3®manufactured by Clariant) meeting the following composition by weight:

$SiO_2$: 21% by weight $Li_2O$: 2.9% by weight

Water: qsp 100% by weight 596 g of deionized water were introduced into a 5 liter beaker fitted with a Rayneri® disperser of the 33/300 type and with an 85 mm diameter deflocculating turbine, 4 g of PLURONIC PE 3100® were added with stirring (speed: 250 rpm), mixing was continued for 10 minutes at 350 rpm, 3400 g of lithium silicate solution (KLEBOFON 3®) were added with stirring (speed: 250 rpm).

| Coating composition (D) | % by weight |
|---|---|
| Lithium silicate | 20.3 |
| Surfactant | 0.1 |
| Water | 79.6 |

EXAMPLE 5

Surface Energy of the Coating Composition According to the Surfactant

These tests for determining the surface energy were carried out according to the DIN 53914 or ASTM D 971 standards (test according to Du Noüy).

The tests for measuring the surface energy given in the table below were carried out with the sodium silicate solution (20N32®) used in Example 1 to which various surfactants were added.

| | Surfactant | % by weight | Surface tension (dynes/cm) |
|---|---|---|---|
| Solution (20N32 ®) | — | 0 | 42–45 |
| Solution (20N32 ®) + Surfactant | Non-ionic polypropylene glycol/polyethylene glycol copolymer (PLURONIC PE 3100 ® manufactured by BASF) | 0.1–0.5 | 36–38 |
| Solution (20N32 ®) + Surfactant | Silicon-modified polyether (BYK 348 ® manufactured by BYK) | 0.1–0.5 | 22–23 |
| Solution (20N32 ®) + Surfactant | Non-ionic acetylene glycol (DYNOL 604 AIR ® manufactured by Products) | 0.1 | 27–28 |
| Solution (20N32 ®) + Surfactant | Anionic/non-ionic mixture (DAPRO W95HS ® sold by Elementis) | 0.1 | 27–29 |
| Solution (20N32 ®) + Surfactant | Quaternary ammonium (CYCLOQUART ® manufactured by Clariant) | 0.4 | 36–38 |
| Solution (20N32 ®) + Surfactant | Non-ionic modified polyethoxylated alcohol (TRITON DF 16 ® manufactured by Union Carbide) | 0.1 | 32–33 |

EXAMPLE 6

Lubrication and Corrosion Tests 6-1) Lubrication Tests

These tests were carried out on metal substrate specimens coated with a composition according to the present invention meeting the following composition (% solids by weight relative to the dry coating film obtained):

78% sodium silicate (based on the sodium silicate solution 20N32® of Example 1);

8% acrylic polymer (aqueous emulsion containing 45% solids by weight of POLYSOL M-19® acrylic polymer manufactured by Showa Highpolymer Co. Ltd.); and 14% lubricant, the nature and the composition of which were varied as described in the table below.

The test consisted in rubbing the metal substrate specimen over a length of about 50 mm (see FIG. 1).

The specimens were of 50 mm×200 mm shape and were treated on both sides.

A lateral force ($F_L$) was applied to the specimen and the latter was pulled at a constant speed of 20 mm/min. The pull force $F_T$ was measured after a rubbing distance of 50 mm.

The value of the friction coefficient was expressed by the ratio:

$$\text{friction coefficient } \mu = \frac{\text{pull force}}{2 \times \text{lateral force}} = \frac{F_T}{2F_L}.$$

This test was used to determine the lubrication quality of the coating films tested. The lower the value of μ, the better the lubrication.

The measurement temperature was 21±2° C.

The weights of dry coating film layer deposited on the metal substrate specimens were between 1 and 1.2 g/m$^2$.

The measurements given in the table below were obtained for a lateral force $F_L$ of 500 daN.

The control specimen was an electrogalvanized sheet (7.5 μm on each side) to which a layer of ANTICORRIT 4107 S oil (manufactured by Fuchs) was applied in an amount of 2.5 g/m$^2$ on both sides. This oil is widely used in the motor-vehicle industry as a lubricant for sheets intended to be drawn.

| Composition of the dry coating film | Composition of the lubricant contained in the composition of the dry coating film (percentage solids by weight) | μ |
|---|---|---|
| (B1) | 75% PTFE<br>25% PEG | 0.18 |
| (B2) | 50% PTFE<br>50% PEG | 0.176 |
| (B3) | 25% PTFE<br>25% PEG<br>50% PE | 0.177 |
| (B4) | 17% PTFE<br>50% PEG<br>33% PE | 0.169 |
| (B5) | 34% PTFE<br>66% PE | 0.178 |
| (B6) | 100% PEG | 0.203 |
| Control specimen | — | 0.425 |

PTFE = polytetrafluoroethylene;
PEG = polyethylene glycol;
PE = polyethylene.

The friction coefficients of the specimens coated with a dry film of composition according to the present invention (B1) to (B6) were lower than the friction coefficient of the control specimen. This indicates that the lubrication of the specimens coated with a dry film of composition according to the present invention (B1) to (B6) was better than that of the control specimen.

6-2) Corrosion Tests 6-2-1) Accelerated Corrosion Tests

| | Hot-dip galvanized (10 μm) steel control specimen | Hot-dip galvanized (10 μm) steel specimen coated with a dry coating film according to composition (A) with a layer weight of: 0.3 g/m$^2$ | 0.6 g/m$^2$ | 0.9 g/m$^2$ | 1.2 g/m$^2$ |
|---|---|---|---|---|---|
| Hot/wet cycling test (duration: 15 cycles) carried out according to the DIN 50017 standard | White rust over 100% of the surface (after only 5 cycles) | Modification in the appearance: white rust over 70% of the surface | No modification in the appearance | No modification in the appearance | No modification in the appearance |

-continued

| | Hot-dip galvanized (10 μm) steel control specimen | Hot-dip galvanized (10 μm) steel specimen coated with a dry coating film according to composition (A) with a layer weight of: | | | |
|---|---|---|---|---|---|
| | | 0.3 g/m$^2$ | 0.6 g/m$^2$ | 0.9 g/m$^2$ | 1.2 g/m$^2$ |
| Salt-fog test (duration: 48 hours) carried out according to the ISO 9227 standard | White rust over 100% of the surface (after only 24 hours) | White rust over 60% of the surface | White rust over 20% of the surface | White rust over less than 5% of the surface | No modification in the appearance |

6-2-2) Natural Corrosion Tests

These tests consisted in exposing galvanized specimens to natural weathering in an industrial outdoor environment.

| | Control hot-dip galvanized (10 μm) steel specimen | Hot-dip galvanized (10 μm) steel specimen coated with a dry coating film according to composition (A) with a layer weight of between 0.6 and 0.9 g/m$^2$ |
|---|---|---|
| Duration of outdoor exposure: 6 months | Modification in the appearance: white rust over 100% of the surface | No modification in the appearance |
| Duration of outdoor exposure: 9 months | Modification in the appearance: further white rust over 100% of the surface | Slight modification in the appearance (light tarnishing) |

EXAMPLE 7

Results of a Formulation Containing a Silane

| Composition of the coating (E) | % by weight |
|---|---|
| Sodium silicate 20N32 ® | 29.7 |
| Silane = γ-glycidoxypropyl-trimethoxysilane | 3.73 |
| PLURONIC PE 3100 ® | 0.07 |
| Water | 66.5 |

Corrosion Test (DIN 50017 KTW):

| Test: DIN 50017 KTW (20 cycles) | Hot-dip galvanized (10 μm) steel substrate coated with a dry coated film according to composition (A) or (E) with a layer weight of: 0.2 g/m$^2$ | 0.5 g/m$^2$ | 0.65 g/m$^2$ |
|---|---|---|---|
| Formulation (A) | Modification in the appearance: white rust over 90% of the surface | Modification in the appearance: white rust over 50% of the surface | Very slight modification in the appearance: white rust over 15% of the surface |
| Formulation (E) | Very slight modification in the appearance: white rust over 20% of the surface | No modification in the appearance | No modification in the appearance |

These results show that the composition containing the silane is more effective in preventing corrosion than the composition without the silane. Introducing the silane therefore allows the layer weights to be reduced while maintaining the same corrosion protection properties.

The invention claimed is:

1. Coating composition for a metal substrate having a free outer surface, formed by a layer of zinc or of a zinc-based alloy, wherein the coating composition comprises (in % by weight):

sodium and/or potassium and/or lithium silicate(s) incorporated in the form of an aqueous solution: 3%-35% surfactant: 0.01%-1% a silane, in an amount of up to 50% by weight of dry coating, water: qs 100% and wherein said composition has a surface tension value of between 20 mN/m and 50 mN/n.

2. Coating composition according to claim 1, wherein the coating composition comprises (in % by weight):

5 to 30% by weight, of sodium and/or potassium and/or lithium silicate(s); and/or about 0.1% by weight of a surfactant.

3. Coating composition according to claim 1, wherein sodium silicate is used in the composition in the form of an aqueous sodium silicate solution of the following composition by weight:

$SiO_2$: 20%-40%

$Na_2O$: 5%-20%

Water: qs 100%.

4. Coating composition according to claim 1, wherein the potassium silicate is used in the composition in the form of an aqueous potassium silicate solution of the following composition by weight:

$SiO_2$: 15%-35%

$K_2O$: 5%-35%

Water: qs 100%.

5. Coating composition according to claim 1, wherein the lithium silicate is used in the composition in the form of an aqueous lithium silicate solution of the following composition by weight:

$SiO_2$: 15%-40%

$Li_2O$: 1%-10%

Water: qs 100%.

6. Coating composition according to claim 1, wherein the surfactant is chosen from a polypropylene glycol/polyethylene glycol copolymer, a silicone-based resin, an acetylene glycol, an anionic/nonionic mixture, a quaternary ammonium, a modified polyethyoxylated alcohol or one of their mixtures.

7. Coating composition according to claim 1, wherein the coating composition has an alkaline pH.

8. Coating composition according to claim 1, wherein the coating upon drying, exhibits a glass transition temperature, the coating composition furthermore includes a polymer whose function is to lower the glass transition temperature of the dry coating.

9. Coating composition according to claim 8, wherein said polymer is added to the said composition in the form of a dispersion or emulsion in water or of an aqueous solution.

10. Coating composition according to claim 8, wherein said polymer is added to the said composition in an amount of up to 60% by weight of the dry coating.

11. Coating composition according to claim 1, wherein the coating composition furthermore includes an additive for reducing free surface alkalinity of the dry coating, in an amount of up to 25% by weight of dry coating.

12. Coating composition according to claim 1, wherein the coating composition furthermore includes an additive for increasing anticorrosion properties of the dry coating, in an amount of up to 25% by weight of dry coating.

13. Coating composition according to claim 1, wherein the coating composition furthermore comprises a lubricant.

14. Coating composition according to claim 13, wherein the lubricant is added to the said coating composition in an amount of up to 15% by weight of dry coating.

15. Coating composition according to claim 1, wherein the coating composition furthermore includes an antifoam agent.

16. Coating composition according to claim 1, wherein the composition has a surface tension value of between 22 mN/m and 45 mN/m.

17. Coating composition according to claim 1, that furthermore comprises conducting pigments.

18. Coating composition according to claim 8, wherein said polymer is selected from the group consisting of an acrylic polymer or copolymer, a polyurethane, an alkyl, an epoxy ester and mixtures thereof.

19. Coating composition according to claim 11, wherein said additive is selected from the group consisting of a cerium salt, a lanthanum salt, a molybdenum salt, molybdic acid, paratoluenesulphonic acid and a polyol, and mixtures thereof.

20. Coating composition according to claim 12, wherein said additive is selected from the group consisting of a titanate and a zirconate, and mixtures thereof.

21. Coating composition according to claim 13, wherein said lubricant is selected from the group consisting of polytetrafluoroethylene, polyethylene, polyethylene glycol, carnauba wax and a paraffin wax, and mixtures thereof.

22. Coating composition according to claim 17, wherein said pigment is selected from the group consisting of iron phosphite, ammonium silicate, nickel, tungsten, zinc and carbon.

23. Coating composition according to claim 14 wherein the lubricant is added to the coating composition in an amount of between 1.5 and 15% by weight of dry coating.

24. Metal substrate coated with a composition according to claim 1.

25. Method of applying a composition according to claim 1, to a metal substrate comprising a free outer surface formed by a metal layer based on zinc or on a zinc-based alloy, wherein the method includes an operation comprising depositing a wet film of the said composition, followed by an operation of drying the metal substrate thus coated, giving rise to a dry coating film on the said substrate.

26. Method according to claim 25, wherein the film of the coating composition is deposited in the form of a wet film with a thickness of between 0.3 μm and 39 μm.

27. Method according to claim 25, wherein the film of the coating composition is deposited in the form of a wet film applied in an amount of 0.6 $g/m^2$ to 40 $g/m^2$.

28. Method according to claim 25, wherein the operation of depositing the wet film comprises spraying.

29. Method according to claim 25, wherein the operation of depositing the wet film comprises spraying followed by an operation of draining the wet film deposited so as to allow its thickness to be controlled.

30. Method according to claim 25, wherein the operation of depositing the wet film comprises dipping followed by an operation to drain off excess liquid so as to control the thickness of the wet film deposited.

31. Method according to claim 29, wherein the operation to drain off excess liquid comprises using a set of drain-off rolls.

32. Method according to claim 25, wherein the operation of depositing the wet film comprises using a coating apparatus comprising at least one roll.

33. Method according to claim 25, wherein the drying operation comprises heating the metal substrate or the wet film so as to heat the said metal substrate and the said wet film to a temperature between room temperature and 240° C.

34. Method according to claim 33, wherein the drying operation comprises heating the metal substrate or the wet film so as to heat the said metal substrate and the said wet film to a temperature of at least about 35° C. for a time of between 2 and 10 seconds if convection heating is used, or between 1 to 2 seconds, if induction or infrared heating is used.

35. Method according to claim 25, wherein the drying operation is carried out so as to obtain a final thickness of the dry coating film of between 0.05 μm and 0.80 μm.

36. Method according to claim 25, wherein the drying operation is carried out so as to obtain a dry coating film layer weight of between 0.1 $g/m^2$ and 1.3 $g/m^2$.

37. Method according to claim 25, wherein the wet film deposition and drying operations are carried out between an operation of zinc or the zinc-based-alloy metal coating the said metal substrate and a final coiling operation.

38. Dry coating film produced by the method according to claim 25, wherein the dry coating film comprises at least 40% by weight of at least one of sodium silicate(s), potassium silicate(s), and lithium silicate(s) relative to the total weight of the dry coating film.

39. Method for protecting metal sheets against corrosion, comprising applying to said metal sheets the coating composition according to claim 1.

40. Method for lubricating metal sheets for the purpose of forming them, comprising applying to said metal sheets the coating composition according to claim 13.

41. Method according to claim 40, wherein said metal sheets are intended to be folded, bended or drew.

42. Method for preventing finger-prints on metal sheets, comprising applying to said metal sheets the coating composition according to claim 1.

* * * * *